US006761465B2

(12) United States Patent
Little

(10) Patent No.: US 6,761,465 B2
(45) Date of Patent: Jul. 13, 2004

(54) ILLUMINATED HEADSTONE MOUNTING ASSEMBLY

(76) Inventor: Shirley E. Little, 906 17th St., Tell City, Perry County, IN (US) 47586

( * ) Notice: Subject to any disclaimer, the term of this patent is extended or adjusted under 35 U.S.C. 154(b) by 0 days.

(21) Appl. No.: 10/319,925

(22) Filed: Dec. 16, 2002

(65) Prior Publication Data

US 2003/0137832 A1 Jul. 24, 2003

Related U.S. Application Data

(60) Provisional application No. 60/350,508, filed on Jan. 24, 2002.

(51) Int. Cl.[7] ..... F21V 33/00

(52) U.S. Cl. ..... 362/183; 362/253; 362/190; 362/191; 248/313; 248/231.41

(58) Field of Search ..... 362/183, 253, 362/190, 191; 47/39; 52/103, 104; 40/124.5; 248/311.2, 231.41, 313

(56) References Cited

U.S. PATENT DOCUMENTS 4,463,527 A * 8/1984 Schlosser ..... 52/103
5,564,816 A * 10/1996 Arcadia et al. ..... 362/183
5,687,515 A * 11/1997 Rodrigues et al. ..... 52/103
6,094,871 A * 8/2000 Arnold et al. ..... 52/103
6,132,054 A * 10/2000 Rogers et al. ..... 362/86
6,173,539 B1 * 1/2001 Barnes ..... 52/103

* cited by examiner

*Primary Examiner*—Thomas M. Sember
(74) *Attorney, Agent, or Firm*—Gary K. Price, Esq.

(57) ABSTRACT

An assembly developed for the purpose of detachably mounting an illuminating means to the upper portion of an existing headstone or monument by means of an appropriate mounting assembly. In place, the mounting assembly extends above the top portion of the headstone, and preferably, a lighting means, such as a solar powered light provides illumination over the headstone or monument. The mounting assembly includes a base member, and a lower bracket assembly for detachably mounting the monument assembly to the top portion of a headstone or monument. The lower bracket assembly cooperates with the back panel member so that the lower portion of the back panel member and a vertical end of the lower bracket assembly extends downward and adjustably overlap the top portion of the headstone. Through the use of an open channel in the horizontal portion of the lower bracket assembly and bolts, the subject invention allows for mounting the mounting assembly to the top portion of the headstone without disfiguring the headstone. When the lower bracket assembly is positioned correctly, the inside surface of the back panel member and the inner surface of the vertical.

19 Claims, 3 Drawing Sheets

J1
25
27
80
27A
20
F
25A
10
H
31
70
30
J2
70
35
80A
32
50
25A
67
25B
80
67A
60
35A
65
J3
65A

ILLUMINATED HEADSTONE MOUNTING ASSEMBLY

CROSS REFERENCES TO RELATED APPLICATIONS

U.S. Provisional Application for Patent No. 60/350,508, filed Jan. 24, 2002, with title "Illuminated Headstone Mounting Assembly" which is hereby incorporated by reference. Applicant claims priority pursuant to 35 U.S.C. Par. 119(e)(i).

STATEMENT AS TO RIGHTS TO INVENTION MADE UNDER FEDERALLY SPONSORED RESEARCH AND DEVELOPMENT:

Not Applicable

BACKGROUND OF THE INVENTION

1. Field of the Invention

This invention relates to an assembly for detachably mounting to the upper portion of a headstone or monument situated in a cemetery. The assembly includes an illumination means, preferably a solar powered lighting that is releasably attached to the assembly and illuminates over the headstone.

2. Brief Description of Prior Art

In the prior art, there exists many varying assemblies to allow displaying of various items, such as flowers, photos and other mementos at grave sites. More specifically, assemblies of various designs and configurations previously devised and utilized that attach to headstones or monuments at the cemetery are known to consist basically of familiar, expected and obvious structural configurations in the crowed prior art.

U.S. Pat. No. 5,564,816 discloses an illuminated memorial assembly having an opaque hollow structure that is mounted to a tombstone, and includes a light source contained within the eternal region of the structure. The structure may be mounted to the tombstone in a number of ways, including bolting the structure to the tombstone by first drilling holes in the tombstone, or drilling a hole into the tombstone and cementing an anchor element in place, which anchor element is attached to the structure. As such, the existing tombstone is required to be disfigured with application of the '816 disclosure.

U.S. Pat. No. 5,065,291 discloses a marking light including a light source that is supported upon a stake, which marking light is positioned by pressing the stake into the earth so as to position the light source at a particular desired delineation or demarcation position.

U.S. Pat. No. 5,687,515 discloses a display case for detachably mounting to the upper portion of the headstone or monument. Said display case having a bottom panel, a front panel, two opposite side panels, two roof panels, a back panel hingedly attached to the bottom panel, it being intended that the interior of the case is for the display of contents. The mounting assembly of '515 further includes a series of front and rear face plates detachable mounted to the top portion of the monument by swivel bolts and attached to the display case by threaded bolts. As such, application of '515 requires disfiguring of the headstone/monument.

As will be seen from the subsequent description, the preferred embodiment of the present invention overcomes these and other short comings of prior art. The assembly according to the present invention departs from the conventional concepts and designs of the prior art, and in doing so, provides an assembly primarily that is detachably mounted to the upper portion of the headstone or monument without requiring the disfiguring of the monument, and includes an illumination means, that is preferably a solar powered light fixture, that illuminates over the headstone or monument. It should be appreciated that there exists a continuing need for a new and improved means used for illuminating individual headstones or monuments. In this regard, the present invention substantially fulfills this need.

SUMMARY OF THE INVENTION

The present invention is designed to provide an improved illuminated headstone monument assembly developed for the purpose of detachably mounting to the upper portion of an existing headstone or monument by means of an appropriate mounting assembly. In place, the mounting assembly extends above the top portion of the headstone, and preferably, a lighting means, such as a solar powered light provides illumination over the headstone or monument. The mounting assembly includes a base member, and a lower bracket assembly for detachably mounting the monument assembly to the top portion of a headstone or monument. The base member formed of an upwardly extending back panel member attached to a top panel member, said top panel member in perpendicular relationship to the back panel member. The top panel member includes an aperture adapted to receive the illuminating means. The lower bracket assembly cooperates with the back panel member so that the lower portion of the back panel member and a vertical end of the lower bracket assembly extends downward and adjustably overlap the top portion of the headstone.

The lower bracket assembly includes a horizontal mounting plate having an open channel that substantially extends the longitudinal axis of the mounting plate and forms an access opening in the mounting plate. The lower bracket assembly further includes a movable member formed of a vertical portion attached to a horizontal portion. At least two threaded screw holes are disposed through the horizontal portion for threadably receiving swivel bolts. The mounting assembly further includes elongated protective pads selectively positioned at those portions of the mounting apparatus that is in contact with the top portion of the headstone in order to prevent the mounting assembly from shifting once mounted to the headstone or monument, and such pads further prevent any penetration and resulting damage caused from the components of the mounting assembly in contact with the headstone or monument.

When the lower bracket assembly is positioned correctly, the inside surface of the back panel member and the inner surface of the vertical portion of the lower bracket assembly should result in a compression of the mounting assembly against the front and back surfaces of the headstone which secures the mounting assembly to the headstone, so that the mounting assembly extends vertically over the headstone, and the illuminating means illuminates over the headstone.

The characteristics and advantages of the invention are further sufficiently referred to in connection with the accompanying drawings, which represent one embodiment. After considering this example, skilled persons will understand that variations may be made without departing from the principles disclosed.

DESCRIPTION OF THE PREFERRED EMBODIMENTS

The following description is provided to enable any persons skilled in the art to make and use the invention, and sets forth the best modes contemplated by the inventor of carrying out his invention. Various modifications, however, will remain readily apparent to those skilled in the art, since the generic principles of the present invention have been defined herein specifically to provide for a novel, improved and simplified means for an assembly that illuminates a headstone.

Figure 1:
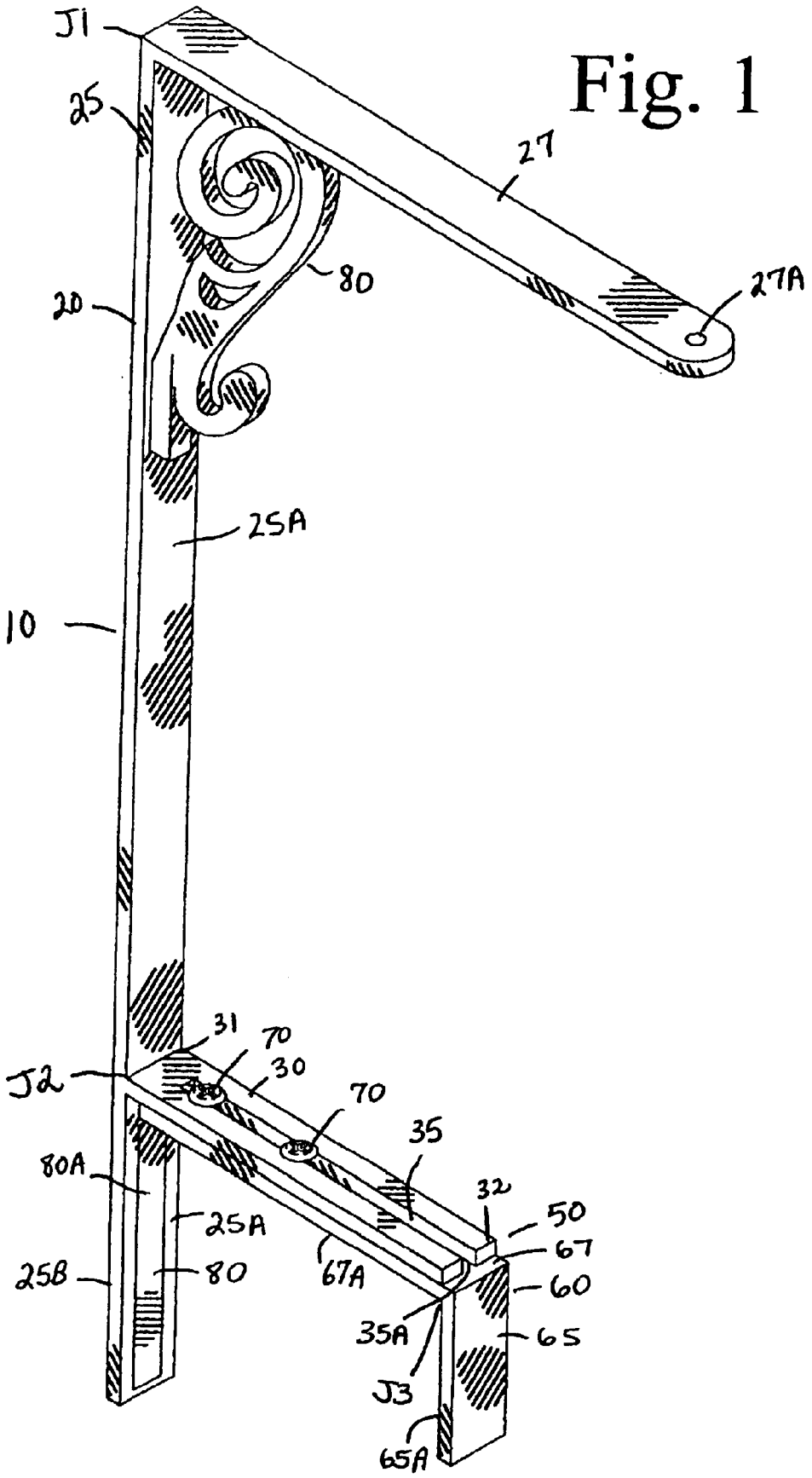
FIG. 1 is a perspective view of the present invention, an illuminated headstone mounting assembly.
Figure 2:
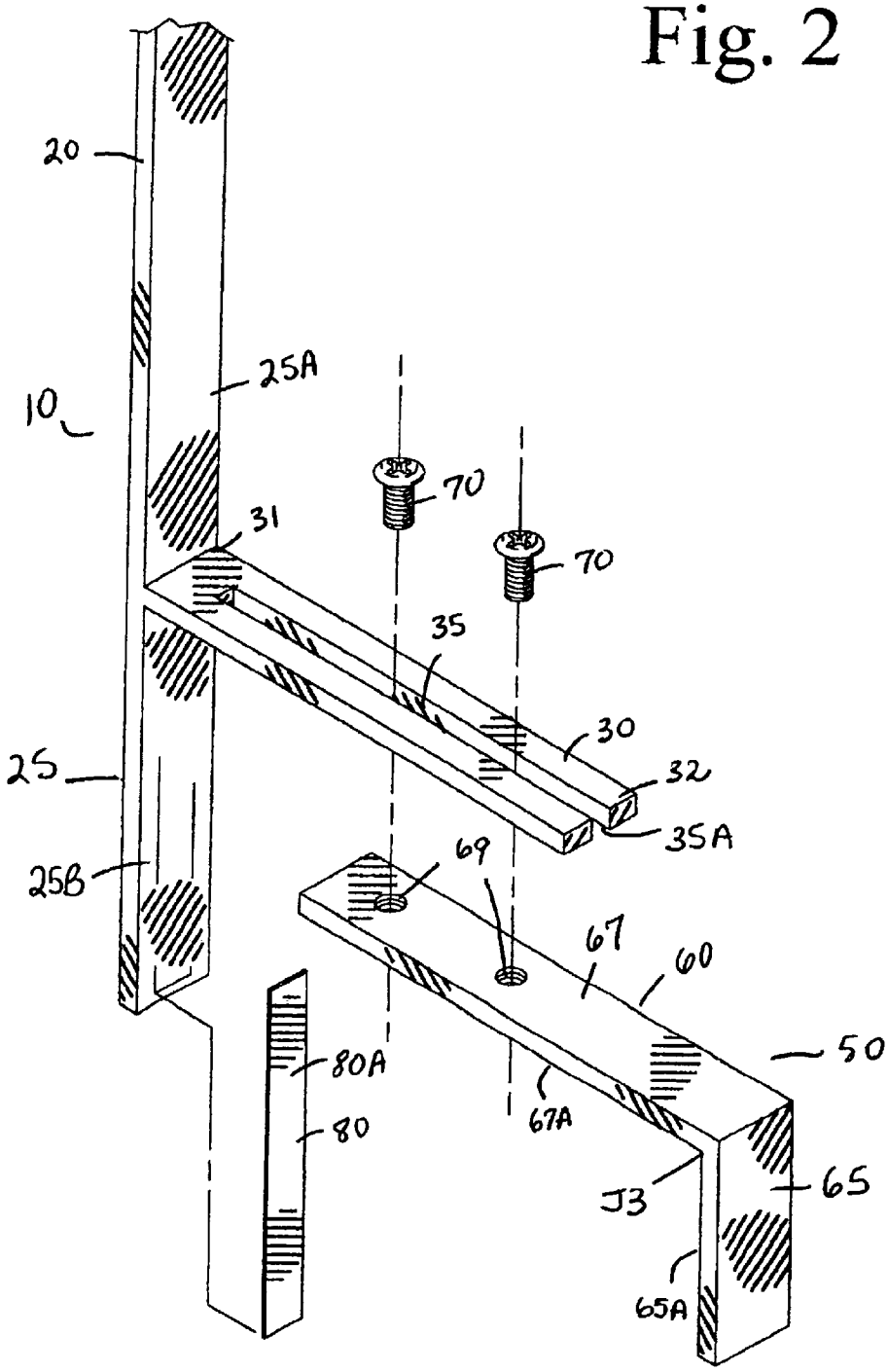
FIG. 2 is an exploded view of the lower bracket assembly of the assembly of FIG. 1.
Figure 3:
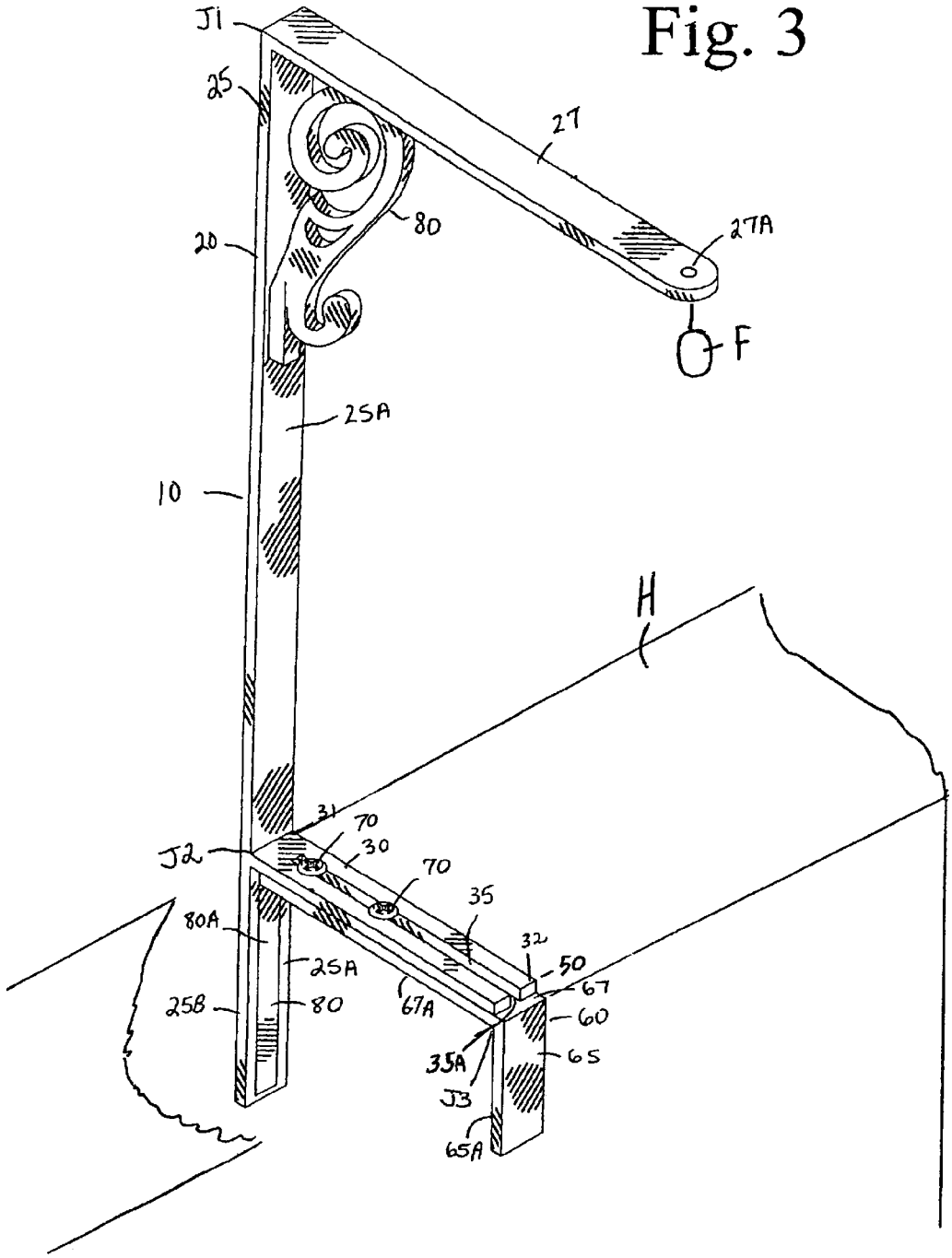
FIG. 3 is a perspective view of the assembly of FIG. 1 mounted to a headstone.

FIGS. 1–3 illustrate a preferred embodiment of a mounting assembly 10 made in accordance with the present invention. The mounting assembly 10 provides an assembly for detachably mounting to the upper portion of a headstone or monument H situated in a cemetery. The mounting assembly 10 extends above the upper portion of the headstone H and provides a means for illuminating the headstone or monument H.

Specifically, it will be noted in the drawings that the assembly of the present invention relates to an apparatus for detachably mounting to the upper portion of the headstone or monument. In the preferred embodiment, the assembly includes an illuminating means for providing light over the headstone or monument. In the broadest context, the assembly consists of components configured and correlated with respect to each other so as to attain the desired objective.

As shown in FIGS. 1–3, the monument assembly 10 generally includes an inverted L-shaped base member 20, and a lower bracket assembly 50 for detachably mounting the monument assembly 10 to a top portion of a the headstone or monument H situated in a cemetery and shown in FIG. 1 partially cut away for clarity. In place, the mounting assembly 10 extends above the upper portion of the headstone H and provides a means for illuminating the headstone or monument H.

Such headstones or monuments are well known in the art, and generally consist of a substantially upright body with said top portion and a bottom portion, and having a decorative exterior bearing identifying indicia. The bottom portion mounted on a concrete foundation which is disposed within the ground.

Referring now to FIG. 1, the base member 20 formed of an upwardly extending back panel member 25, and a top panel member 27, said top panel member 27 in perpendicular relationship to the back panel member 25. Said back panel member having an inside surface 25A. The back panel member 25 may be appropriately joined to the top panel member 27 at joint J1 with means known in the art such as with screws or welding, or, the back panel member 25 and the top panel member 27 may be manufactured as one piece. The base member 20 preferably is relatively light-weight and may be constructed, e.g., from stainless steel, aluminum, plastic, and any other material that is rigid, preferably easy to machine, and which will provide a reasonable amount of weather resistance.

The top panel member 27 further includes an aperture 27A formed therethrough. Said aperture 27A disposed near the end of the top panel member 27 opposite the joint J1, and adapted to receive an illuminating means F that is suspended from the aperture 27A. As will be apparent to those skilled in the art, different fixtures other than lighting means, such as a hanging flower basket for example, may, at the option of the purchaser of the mounting assembly 10, be installed and/or removed from the aperture 27A.

In general, the lower bracket assembly 50 cooperates with the back panel member 25 so that the lower portion of the back panel member 25 and a vertical end of the lower bracket assembly 50 extends downward and adjustably overlap the top portion of the headstone H. Through the use of an open channel in the top portion of the lower bracket assembly 50 and bolts, the subject invention allows for the mounting of the mounting assembly 10 to the top portion of the headstone H without disfiguring the headstone.

When the lower bracket assembly 50 is positioned correctly as will be described, the inside surface of the back panel member and the inner surface of the vertical end of the lower bracket assembly 50 should result in a compression of the mounting assembly 10 against the front and back surfaces of the headstone H which secures the mounting assembly 10 to the headstone H, so that the mounting assembly 10 extends vertically over the headstone H, and the illuminating means F illuminates over the headstone H. The lower bracket assembly 50 may consist essentially of any of the durable, relatively weather resistant materials described elsewhere in this specification such as, e.g., plastic, stainless steel, aluminum, and the like.

Referring to FIG. 2, the lower bracket assembly 50 includes a horizontal mounting plate 30 having a first end 31 and a distal end 32 opposite the first end 31. Said first end 31 of the mounting plate 30 joined to the inside surface 25A of the back panel member 25 at joint J2 with means known in the art such as with screws or welding, or, the back panel member 25 and the mounting plate 30 may be manufactured as one piece. In place, the mounting plate 30 and the top panel member 27 are in parallel relationship.

As shown in the drawings, the mounting plate 30 includes an open channel 35 that substantially extends the longitudinal axis of the mounting plate 30 and forms an access opening 35A at the distal end 32 of the mounting plate 30. The lower bracket assembly 50 further includes a movable member 60 having an inverted L-shaped configuration. The movable member 60 formed of a vertical portion 65 and a horizontal portion 67, said vertical portion 65 in parallel relationship with the back panel member 25, and the horizontal portion 67 in parallel relationship with the horizontal mounting plate 30. The vertical portion 65 may be appropriately joined to the horizontal portion 67 at joint J3 with means known in the art such as with screws or welding, or, the vertical portion 65 and the horizontal portion 67 may be manufactured as one piece.

At least two threaded screw holes 69 are disposed through the horizontal portion 67 for threadably receiving swivel bolts 70 as will be further discussed. As best shown in FIG. 2, the mounting assembly 10 further includes an elongated protective pad 80 attached to a lower end 25B of the inside surface 25A of the back panel member 25. Specifically, the pad 80 is positioned on the back panel member 25 so that the pad 80 is in parallel relationship with the vertical portion 65, and so that an outer surface 80A of the pad 80 faces an inner surface 65A of the vertical portion 65. As will be understood, in application, the outer surface 80A of the protective pad 80 abuts the surface of the top portion of the headstone H, and prevents the mounting assembly 10 from sliding or shifting once the mounting assembly 10 is mounted to the headstone H. Additional pads (not shown) may be attached to the inner surface 65A of the vertical portion 65 and a lower surface 67A of the horizontal portion 67. In this configuration, protective pads are then attached to those portions of the mounting apparatus 10 that is in contact with the top portion of the headstone H. Said protective pad(s) are preferably made of any non-abrasive, weather resistant material known in the art. Additional protective covers (not shown) may further be disposed on the lower surface 67A of the horizontal portion 67, and in alignment over the threaded screw holes 69 to prevent the bolts 70 from passing through the horizontal portion 67 and penetrating the headstone H, thereby resulting in permanent damage to the headstone H.

The detachable feature of the mounting assembly 10 to the headstone H is accomplished through the adjustment of the distance between the inner surface 65A of the vertical portion 65 and the inside surface 25A of the back panel member 40. The threaded swivel bolts 70 are slidably passed through the channel slot 35 of the mounting plate 30 into the threaded holes 69 of the horizontal portion 60 of the movable member 60. Then, prior to tightening the bolts 70, slidably changing the distance between the inner surface 65A and the inside surface 25A relative to the width of the top portion of the headstone H, by sliding the horizontal portion 67 of the movable member 60 along the axial length of the horizontal mounting plate 30. Such movement causing the swivel bolts 70 threadably attached to the horizontal portion to slide along the horizontal axis of the open channel 35 in the mounting plate 30. This facilitates adjustment of the movable member 60 of the lower bracket assembly 50 relative to the width of the top portion of the headstone H. Once movement of the movable member 60 as discussed above is complete, so that a sufficient squeezing force exists between the inside surface 25A (in abutting communication with the back side surface of the headstone H) and the inner surface 65A (in abutting communication with the front side surface of the headstone H) to secure the mounting assembly 10 against the front and back surfaces of the headstone H, the swivel bolts 70 tighten the assembly 10 into place. In application, the inside surface 25A of the back panel member 25 abuts against the back side surface of the headstone H, and the inner surface 65A of the vertical portion 65 abuts against the front side surface of the headstone H.

In the preferred embodiment, the mounting assembly 10 further includes said illuminating means F, which illuminating means F is preferably a solar powered light fixture commonly known in the art. As understood, the light fixture F is removably anchored to the aperture 27A of the top panel member 27, and suspending from the aperture 27 using any anchoring means known to the art. As will be apparent to those skilled in the art, different fixtures other than lighting means, such as a hanging flower basket for example, may, at the option of the purchaser of the mounting assembly 10, be installed and/or removed from the aperture 27A.

When the lower bracket assembly 50 is positioned correctly as described above, the inside surface 25A of the back panel member 25 and the inner surface 65A of the vertical portion 65 should result in a compression of the mounting assembly 10 against the front and back surfaces of the headstone which secures the mounting assembly 10 to the headstone, so that the mounting assembly 10 extends vertically over the headstone, and the solar powered light fixture illuminates over the headstone.

As further shown in FIG. 1, the mounting assembly 10 may further include an ornamental cross-member 80 having one end appropriately attached to the under side of the top panel member 27 and the opposite end of the cross-member 80 attached to the inside surface 25A of the back panel member 25. Such ornamental cross-member 80 is not only for aesthetic purposes, but also provides additional support for the mounting assembly 10 between the members 25 and 27.

While the preferred embodiments of the invention have been shown, illustrated, and described, it will be apparent to those skilled in this field that various modifications may be made in these embodiments without departing from the spirit of the present invention.

Thus the scope of the invention should be determined by the appended claims in the formal application and their legal equivalents, rather than by the examples given.

I claim:

1. A mounting assembly for detachably mounting to the upper portion of a cemetery headstone or monument, the mounting assembly comprising:

a base member formed of an upwardly extending back panel member attached to a top panel member, said back panel member having an inside surface and a lower portion, said top panel having an aperture, and said top panel member approximately perpendicular to the back panel member, a lower bracket assembly having movable member, said movable member having a vertical portion, said vertical portion having an inner surface, attaching means for detachably mounting the mounting assembly to the upper portion of the headstone, wherein the lower bracket assembly cooperates with the back panel member so that the lower portion of the back panel member and the vertical portion of the lower bracket assembly extend downward and overlap the upper portion of the headstone, and wherein said aperture in said top panel is located such that a fixture can be suspended from said top panel and aperture.

2. The mounting assembly as recited in claim 1, wherein the lower bracket assembly includes a horizontal mounting plate, said mounting plate including an open channel that substantially extends a longitudinal axis of the mounting plate forming an access opening, and said movable member includes a horizontal portion attached to said vertical portion, wherein at least two threaded holes are disposed through the horizontal portion for threadably receiving bolts.

3. The mounting assembly as recited in claim 2, wherein the threaded bolts are slidably passed through the channel of the mounting plate into the threaded holes of the horizontal portion of the movable member, slidably changing a distance between the inner surface and the inside surface relative to the width of the top portion of the headstone so that the inside surface of the back panel member and the inner surface of the vertical portion results in a compression of the mounting assembly against front and back surfaces of the headstone which secures the mounting assembly to the headstone.

4. The mounting assembly as recited in claim 1, further comprising an elongated protective pad attached to the inside surface of the lower portion of the back panel member.

5. The mounting assembly as recited in claim 1, further comprising at least one elongated protective pad attached to the lower bracket assembly.

6. The mounting assembly as recited in claim 1, further wherein said fixture is an illuminating means suspended from the aperture of the top panel.

7. The mounting assembly as recited in claim 6, wherein the illuminating means is a solar powered light fixture.

8. The mounting assembly as recited in claim 1, further comprising an ornamental cross-member having one end attached to the top panel member and the opposite end attached to the inside surface of the back panel member.

9. A mounting assembly for detachably mounting to the upper portion of a cemetery headstone or monument, the mounting assembly comprising:

a base member formed of an upwardly extending back panel member attached to a top panel member, said back panel member having an inside surface and a lower portion, said top panel having an aperture, and said top panel member perpendicular to the back panel member, a lower bracket assembly having movable member, said movable member having a vertical portion, said vertical portion having an inner surface wherein the lower bracket assembly cooperates with the back panel member so that the lower portion of the back panel member and the vertical portion of the lower bracket assembly extend downward and overlap the upper portion of the headstone and, wherein said aperture in said top panel is located such that a fixture can be suspended from said top panel and aperture.

10. The mounting assembly as recited in claim 9, wherein the lower bracket assembly includes a horizontal mounting plate having a first end and a distal end opposite the first end, said first end joined to the inside surface of the back panel member, the mounting plate further includes an open channel that substantially extends a longitudinal axis of the mounting plate and forms an access opening at the distal end of the mounting plate, said movable member includes a horizontal portion attached to said vertical portion, said vertical portion in parallel relationship with the back panel member, and the horizontal portion in parallel relationship with the horizontal mounting plate, wherein at least two threaded holes are disposed through the horizontal portion for threadably receiving bolts.

11. The mounting assembly as recited in claim 10, wherein the bolts are slidably passed through the channel of the mounting plate into the threaded holes of the horizontal portion of the movable member, slidably changing a distance between the inner surface and the inside surface relative to a width of the top portion of the headstone so that the inside surface of the back panel member and the inner surface of the vertical portion results in a compression of the mounting assembly against front and back surfaces of the headstone which secures the mounting assembly to the headstone.

12. The mounting assembly as recited in claim 9, further comprising an elongated protective pad attached to the inside surface of the lower portion of the back panel member.

13. The mounting assembly as recited in claim 9, further comprising at least one elongated protective pad attached to the lower bracket assembly.

14. The mounting assembly as recited in claim 9, further wherein said fixture is an illuminating means attached to the aperture of the top panel.

15. The mounting assembly as recited in claim 14, wherein the illuminating means is a solar powered light fixture.

16. The mounting assembly as recited in claim 9, further comprising an ornamental cross-member having one end appropriately attached to the top panel member and the opposite end attached to the inside surface of the back panel member.

17. A mounting assembly for detachably mounting to an upper portion of a cemetery headstone, the mounting assembly comprising:

a base member attached to a top panel member, said base member having a second padded inside surface, said first and second padded surfaces cooperating to form an adjustable mount, an aperture formed inside said top panel member such that a fixture can be suspended from said aperture and supported by said mounting assembly with said first and second padded surfaces protecting said headstone.

18. The mounting assembly as recited in claim 17, further wherein said fixture is a light suspended from the aperture of the top panel.

19. The mounting assembly as recited in claim 17, wherein said adjustable mount includes a channel and bolts such that a distance between said first and second padded surfaces can be adjusted.

* * * * *